US008959677B2

(12) United States Patent
Yul et al.

(10) Patent No.: US 8,959,677 B2
(45) **Date of Patent: *Feb. 24, 2015**

(54) SOFA AIR BED

(75) Inventors: Lee Pil Yul, Fujian (CN); Huang Chang Jiu, Fujian (CN); Ye Zhengyi, Fujian (CN)

(73) Assignee: Seina International, LLC, Labadie, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/074,936

(22) Filed: Mar. 7, 2008

(65) Prior Publication Data

US 2008/0216230 A1 Sep. 11, 2008

(30) Foreign Application Priority Data

Mar. 9, 2007 (CN) ..... 2007 2 0006493 U

(51) Int. Cl.

| | |
|---|---|
| ***A47C 17/00*** | (2006.01) |
| ***A47C 19/00*** | (2006.01) |
| ***A47C 19/12*** | (2006.01) |
| ***A47C 17/64*** | (2006.01) |
| ***A47C 19/14*** | (2006.01) |

(52) U.S. Cl.

CPC ..... *A47C 19/126* (2013.01); *A47C 17/64* (2013.01); *A47C 19/14* (2013.01)

USPC ..... 5/110; 5/111; 5/114; 5/175; 5/181; 5/183

(58) Field of Classification Search

USPC ..... 5/16, 110, 115, 114, 116, 111, 175, 5/176.1, 181, 183; 190/1, 2

See application file for complete search history.

(56) References Cited

U.S. PATENT DOCUMENTS

| | | | | |
|---|---|---|---|---|
| 807,909 | A | 12/1905 | Braznell | |
| 1,549,934 | A | 8/1925 | Vanek et al. | |
| 6,134,727 | A | 10/2000 | Hwang | |
| 6,151,730 | A | 11/2000 | Weston | |
| 6,457,192 | B2 | 10/2002 | Choi et al. | |
| 6,564,402 | B1 | 5/2003 | Lin | |
| 6,581,223 | B1 | 6/2003 | Wang | |
| 6,708,630 | B2 | 3/2004 | Zheng | |
| 6,711,761 | B2 | 3/2004 | Choi | |
| 6,763,534 | B2 | 7/2004 | Hwang | |
| 7,017,984 | B2 | 3/2006 | Chen | |
| 7,114,205 | B2 | 10/2006 | Choi | |
| 8,104,121 | B2 * | 1/2012 | Bourgraf et al. | 5/618 |
| 2004/0000009 | A1 * | 1/2004 | Choi | 5/174 |

* cited by examiner

*Primary Examiner* — Robert G Santos
*Assistant Examiner* — David E Sosnowski
(74) *Attorney, Agent, or Firm* — Armstrong Teasdale LLP

(57) ABSTRACT

A collapsible sofa bed movable between an expanded configuration and a collapsed configuration includes a frame including a plurality of scissor assemblies. Each scissor assembly includes a first frame member pivotally coupled to a second frame member at a pivot point. Frame members of adjacent scissor assemblies are coupled to one of a first connector assembly and a second connector assembly. At least two backrest support members are coupled to the frame. Each backrest support member is slidably coupled to a corresponding first frame member and has a lower end that is pivotally coupled to a corresponding second frame member. Each backrest support member is pivotally movable with respect to the corresponding second frame member.

21 Claims, 6 Drawing Sheets

SOFA AIR BED

CROSS REFERENCE TO RELATED APPLICATIONS

This application claims the benefit of Chinese Patent Application No. 200720006493.5 entitled "Sofa Air Bed" filed on Mar. 9, 2007, which is hereby incorporated by reference in its entirety.

BACKGROUND OF THE INVENTION

The field of the invention relates generally to collapsible furniture, such as a collapsible or folding bed, and, more particularly, to a bed that is convertible into a sofa.

At least one conventional collapsible furniture piece includes two units connected with two connecting assemblies. A gear adjustor is positioned on a backrest that is positioned between a rear seat frame and a front seat frame such that the collapsible furniture piece is movable between a bed and a sofa. However, the gear adjustor is complicated and requires additional time and/or expense to manufacture. Further, the conventional furniture piece is not fully collapsible and, thus, requires adequate storage space and/or is not easily portable.

BRIEF DESCRIPTION OF THE INVENTION

In one aspect, a collapsible sofa bed that is movable between an expanded configuration and a collapsed configuration is provided. The collapsible sofa bed includes a frame including a plurality of scissor assemblies. Each scissor assembly of the plurality of scissor assemblies includes a first frame member pivotally coupled to a second frame member at a pivot point. Frame members of adjacent scissor assemblies are coupled to a first connector assembly or a second connector assembly. At least two backrest support members are coupled to the frame. Each backrest support member of the at least two backrest support members is slidably coupled to a corresponding first frame member and has a lower end pivotally coupled to a corresponding second frame member. Each backrest support member is pivotally movable with respect to the corresponding second frame member.

In another aspect, a collapsible frame movable between an expanded configuration and a collapsed configuration is provided. The collapsible frame includes a plurality of scissor assemblies. Each scissor assembly of the plurality of scissor assemblies includes a first frame member pivotally coupled to a second frame member at a pivot point. Frame members of adjacent scissor assemblies are coupled to a first connector assembly or a second connector assembly. A plurality of backrest support members are coupled to the frame. Each backrest support member of the plurality backrest support members is slidably coupled to a corresponding first frame member and has a first end pivotally coupled to a corresponding second frame member. Each backrest support member is pivotally movable with respect to the corresponding second frame member.

In another aspect, a method for manufacturing a collapsible frame assembly is provided. The method includes forming a collapsible frame including a plurality of scissor assemblies. Each scissor assembly of the plurality of scissor assemblies includes a first frame member pivotally coupled to a second frame member at a pivot point. Frame members of adjacent scissor assemblies are coupled to a first connector assembly or a second connector assembly. A plurality of backrest support members are coupled to the frame. Each backrest support member of the plurality backrest support members is slidably coupled to a corresponding first frame member and has a first end pivotally coupled to a corresponding second frame member. Each backrest support member is pivotally movable with respect to the corresponding second frame member.

DETAILED DESCRIPTION OF THE INVENTION

The present disclosure provides a collapsible and convertible furniture piece including a collapsible and convertible frame that forms a support structure in an expanded configuration suitable for supporting a mattress, such as an inflatable mattress, and one or more users positioned on the mattress. In the expanded configuration, the frame is convertible between a first or bed configuration and a second or sofa configuration. The frame is collapsible from the expanded configuration to a collapsed configuration for easy storage and/or transport. For example, in the collapsed configuration, the frame may be contained within a storage bag. When a sleeping area or a seating area is desired, the frame is movable from the collapsed configuration to the expanded configuration, such as the first configuration or the second configuration, respectively, for supporting the mattress. The mattress is positioned on and supported by the frame in the expanded configuration. In one embodiment, the mattress is removably coupled to the frame.

The present disclosure is described below in reference to its application in connection with and operation of a sofa bed having a collapsible and convertible frame. The sofa bed is convertible between the bed configuration and the sofa configuration with the frame in the expanded configuration. It should be apparent to those skilled in the art and guided by the teachings herein provided that the collapsible and convertible frame is likewise applicable to any suitable foldable and/or collapsible furniture piece, for example.

Figure 4:
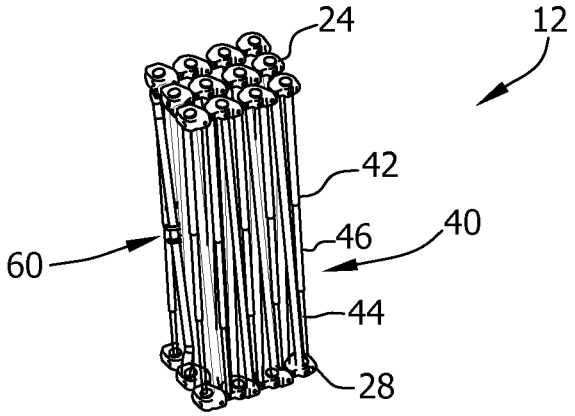
FIG. 4 is a perspective view of the frame shown in FIG. 1 in a collapsed or folded configuration.
Figure 5:
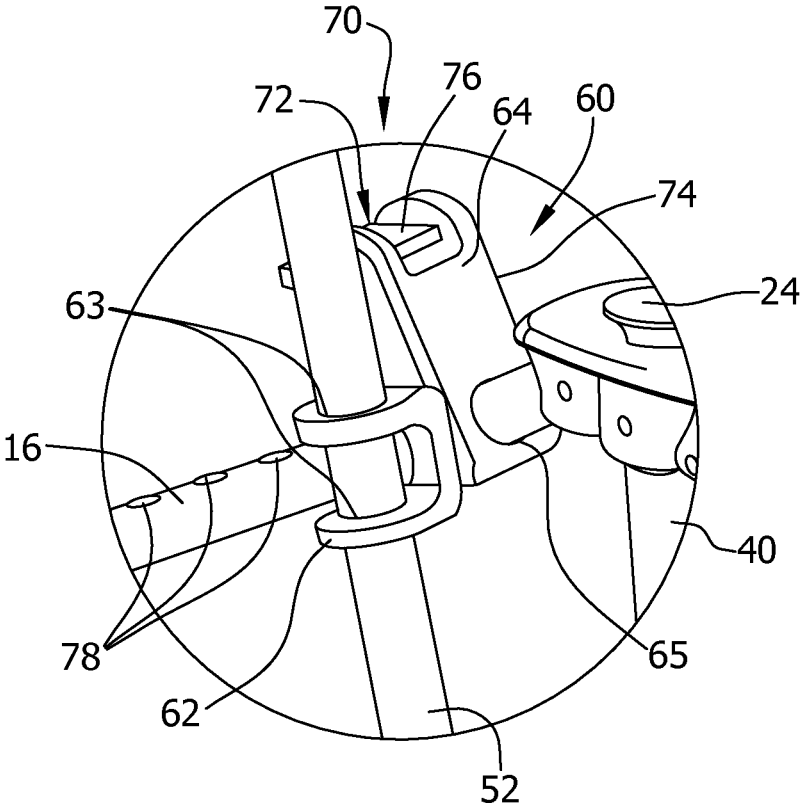
FIG. 5 is an enlarged view of a portion of the frame shown in FIG. 1.
Figure 6:
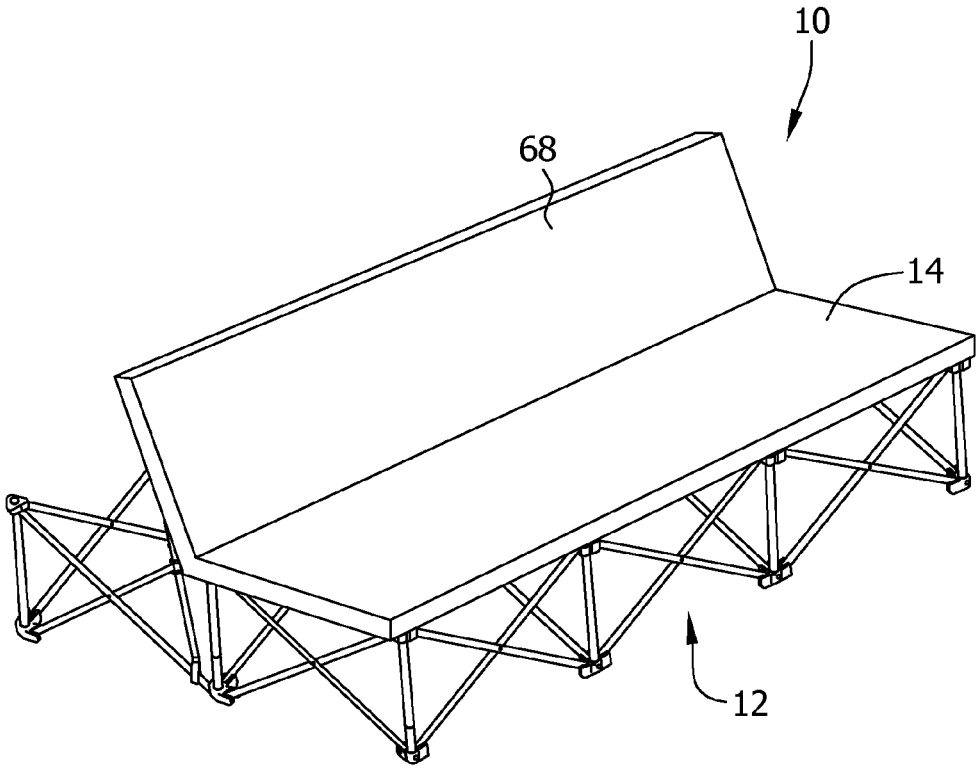
FIG. 6 is a perspective view of a collapsible and convertible furniture piece in a sofa configuration.
Figure 7:
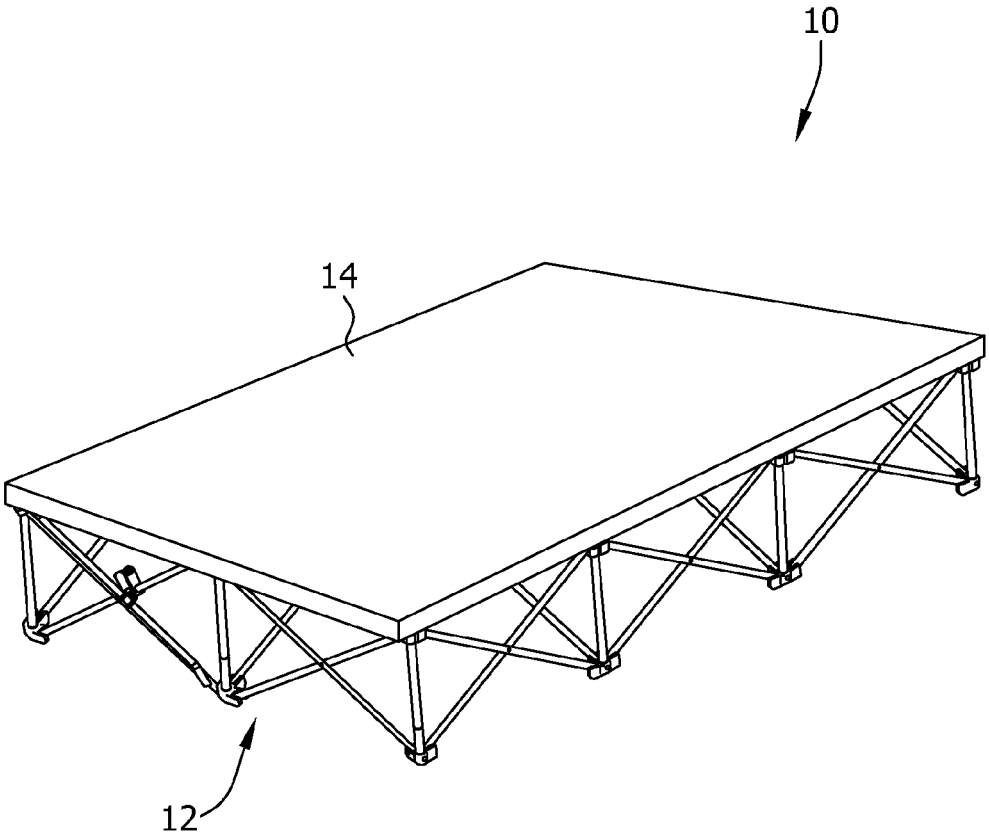
FIG. 7 is a perspective view of a collapsible and convertible furniture piece in a bed configuration.

Referring to FIGS. 1-7, a sofa bed 10 includes a collapsible frame 12 and a mattress 14, such as an inflatable mattress, shown in FIGS. 6 and 7. In one embodiment, mattress 14 is removably positioned within a fabric covering that defines an enclosure having an entry that is sealed with a suitable closure mechanism or fastener, such as a zipper, buttons, snaps, hook-and-loop fastener components, such as VELCRO fastener components, and/or hook-and-eye fastener components. The fabric covering may be a plastic, cloth, or leather material, for example, and encloses at least a portion of mattress 14, which is inserted into the entry.

In one embodiment, sofa bed 10 includes an inflatable mattress 14 coupled to a self-expanding frame 12. Mattress 14 is permanently or removably coupled to frame 12 directly or indirectly, such with an enclosure. In certain embodiments, mattress 14 and/or the enclosure are at least partially permanently or removably coupled to frame 12 using a suitable fastener component, such as buttons, snaps, and/or hook-and-loop fastener components, such as VELCRO fastener components. In a particular embodiment, mattress 14 is coupled, directly or indirectly, to frame 12 at a plurality of locations such that as mattress 14 is filled with air to expand, frame 12 is urged to move outwardly. In a further particular embodiment, an air pump is coupled to an inflation port on mattress 14. The air pump may be electrically operated and powered by a wall current or by batteries. Further, the air pump may include a suitable sensor configured to detect a signal transmitted by a remote control. The remote control activates and deactivates the electric pump by transmitting a corresponding signal that is detected by the sensor. Alternatively or in addition, the air pump may have a manual on-off switch. In an alternative embodiment, mattress 14 is manually inflated.

In one embodiment, frame 12 includes a plurality of frame members joined by pivot assemblies such that lower connector assemblies move laterally within a common horizontal plane as the frame as a whole expands outwardly from a central reference area to expand sofa bed 10 outwardly from the central reference area. Frame 12 is urged outwardly from the central reference area, thus causing frame 12 to expand outwardly as a whole from the central reference area and mattress 14 is inflated. In a particular embodiment, mattress 14 is coupled to frame 12 at a plurality of attachment points such that as mattress 14 is inflated and expands outwardly, frame 12 also expands outwardly. Mattress 14 may be coupled to frame 12 with a fabric covering, which encloses at least a portion of mattress 14. The fabric covering is coupled to frame 12 at a plurality of attachment points, for example at a plurality of upper connector assemblies, such that as mattress 14 is inflated and expands outwardly, the fabric covering expands outwardly, causing frame 12 to also expand outwardly.

Referring now to FIGS. 1-7, in one embodiment, frame 12 includes a plurality of first frame members 16 pivotally coupled to a corresponding second frame member 18 at a pivot point or joint 19, such as at a midpoint of first frame member 16 and second frame member 18, to form a plurality of scissor assemblies 20. A pivot member, such as a bolt, screw or rivet, pivotally couples first frame member 16 to second frame member 18. Each first frame member 16 is pivotally coupled at or near a first end 22 to an upper connector assembly 24 and pivotally coupled at or near an opposing second end 26 to a lower connector assembly or foot 28. Each second frame member 18 is pivotally coupled at or near a first end 32 to a corresponding lower connector assembly 28 and pivotally coupled at or near an opposing second end 34 to a corresponding upper connector assembly 24. Upper connector assembly 24 and/or lower connector assembly 28 couple adjacent or cooperating first frame members 16 and second frame members 18 so there are no loose pieces to be gathered and assembled.

Figure 1:
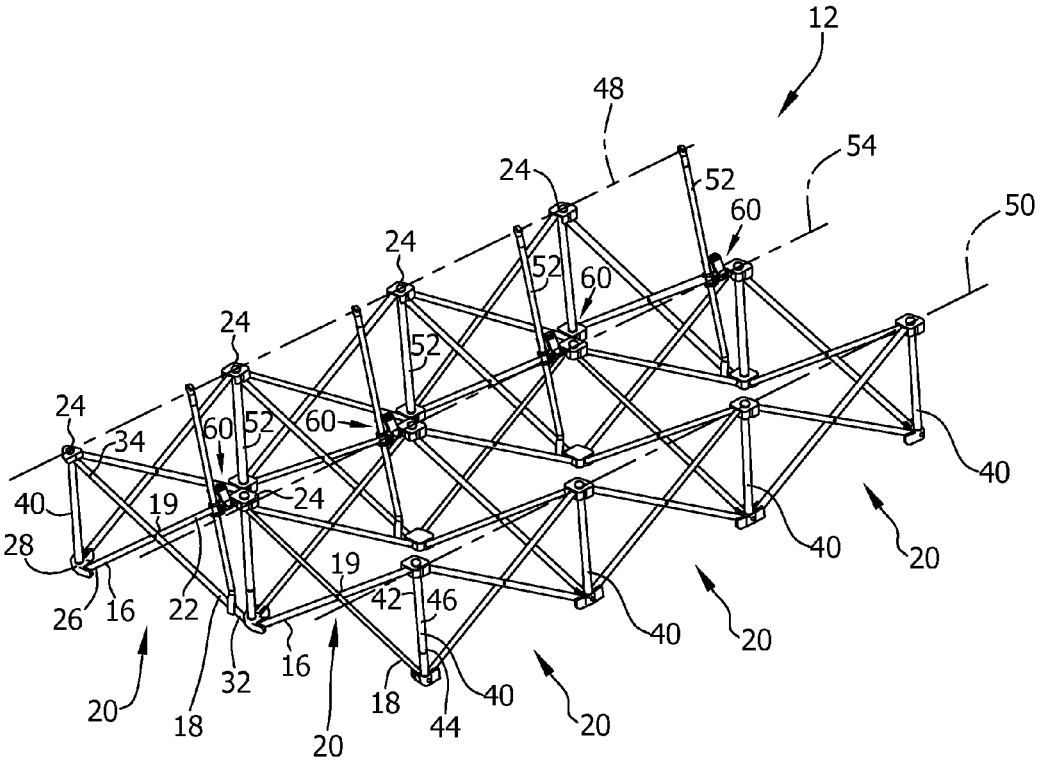
FIG. 1 is a perspective view of a suitable frame for an exemplary collapsible and convertible furniture piece in a sofa frame configuration.
Figure 2:
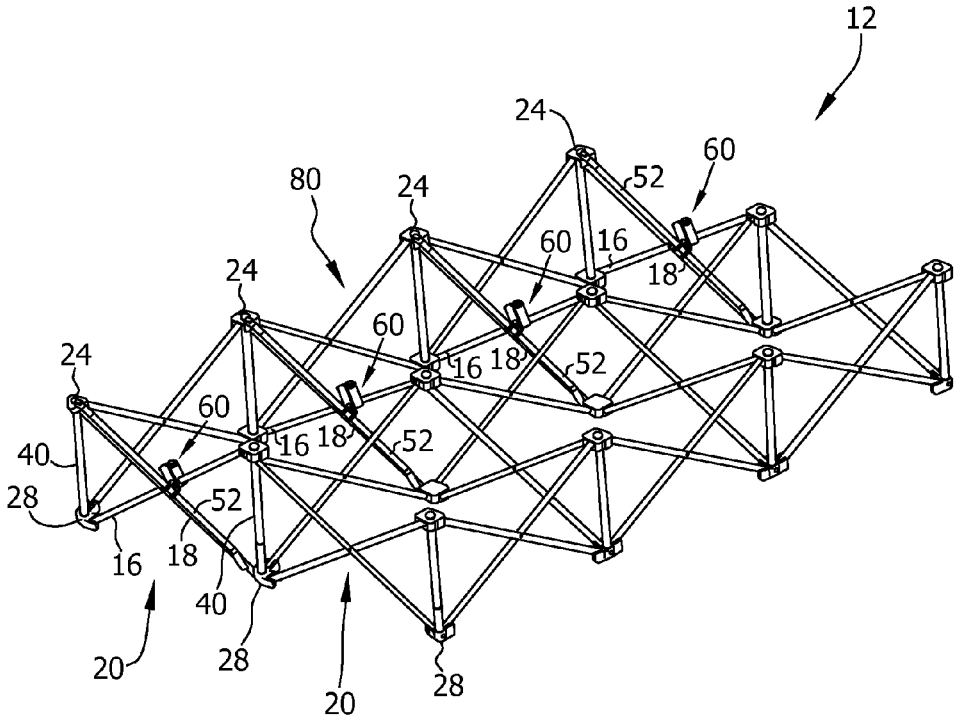
FIG. 2 is a perspective view of the frame shown in FIG. 1 in a bed frame configuration.
Figure 3:
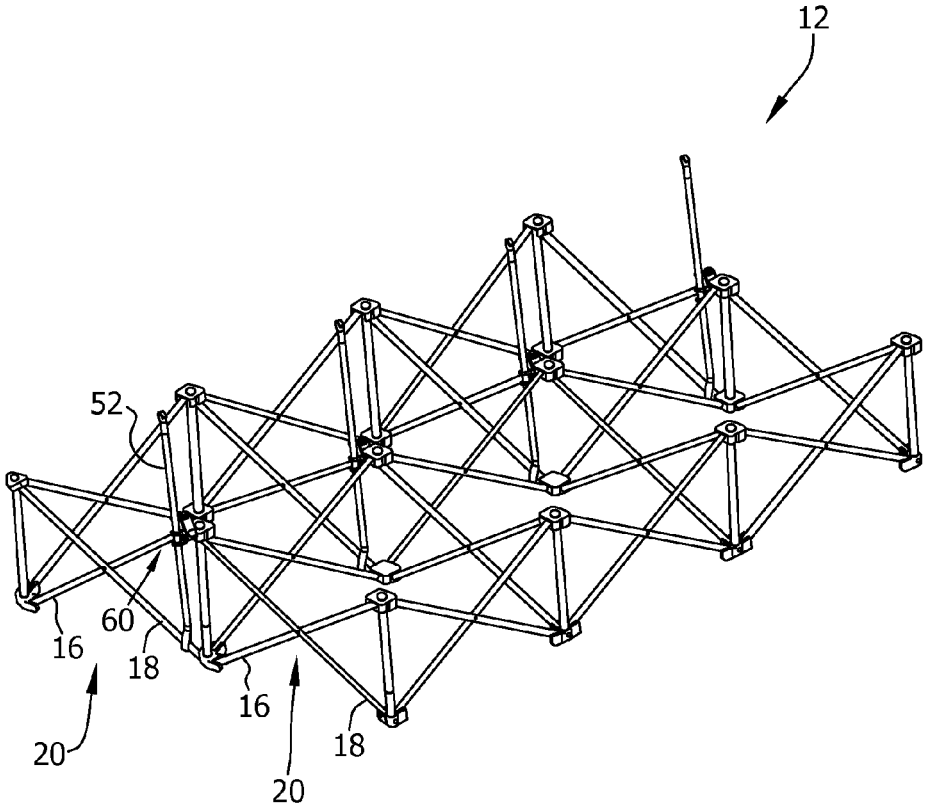
FIG. 3 is a perspective view of the frame shown in FIG. 1 in a partially expanded configuration.

Scissor assemblies 20 facilitate moving frame 12 between the expanded configuration, such as shown in FIGS. 1 and 2, and the collapsed configuration, as shown in FIG. 4. More specifically, each scissor assembly 20 includes first frame member 16 pivotally coupled to corresponding second frame member 18 at pivot point 19. Frame 12 is moved towards the collapsed configuration as first frame member 16 pivots with respect to second frame member 18 to urge first end 22 of first frame member 16 towards second end 34 of second frame member 18 to urge adjacent upper connector assemblies 24 together. Similarly, second end 26 of first frame member 16 is urged towards first end 32 of second frame member 18 to urge adjacent lower connector assemblies 28 together. Conversely, frame 12 is moved from the collapsed configuration towards the expanded configuration as first frame member 16 pivots with respect to second frame member 18 to urge first end 22 of first frame member 16 away from second end 34 of second frame member 18 to urge adjacent upper connector assemblies 24 apart. Similarly, second end 26 of first frame member 16 is urged away from first end 32 of second frame member 18 to urge adjacent lower connector assemblies 28 apart.

In one embodiment, a force directed at one or more corners of frame 12 causes movement in other corners such that frame 12 moves as a whole inwardly with respect to a central reference area of frame 12 to facilitate moving frame 12 to the collapsed configuration or outwardly relative to the central reference area to facilitate moving frame 12 to the expanded configuration. Further, upper connector assemblies 24 and lower connector assemblies 28, as well as pivot points 19, allow frame 12 to move as a unit when frame 12 is collapsed and expanded. It should be apparent to those skilled in the art and guided by the teachings herein provided that one lower connector assembly 28 may remain substantially fixed or stationary as frame 12 is collapsed or expanded, while the remaining lower connector assemblies 28 move inwardly or outwardly, respectively. As such, the central reference area may itself move. For example, when frame 12 is located within a room such that one lower connector assembly 28 is positioned in a corner of the room, movement of frame 12 is constrained. As frame 12 moves towards the expanded configuration, the remaining non-constrained lower connector assemblies 28 expand outwardly from the central reference area as the central reference area itself moves outwardly with respect to the stationary lower connector assembly 28.

As shown in FIGS. 1-4, a plurality of support members 40 are positioned about an outer periphery of frame 12 at least partially defined by upper connector assemblies 24 and/or lower connector assemblies 28. Each support member 40 includes a plurality of telescoping segments and is coupled between upper connector assembly 24 and corresponding lower connector assembly 28. In one embodiment, each support member 40 includes a first segment 42 pivotally coupled to upper connector assembly 24, a second segment 44 pivotally coupled to lower connector assembly 28, and a third segment 46 slidably coupled between first segment 42 and second segment 44. Referring further to FIGS. 1 and 2, four support members 40 are positioned in a first or rear longitudinal row or line 48 defined by upper connector assemblies 24 along a length of frame 12 at a first lateral edge of frame 12 and four support members 40 positioned in a second or front longitudinal row or line 50 defined by upper connector assemblies 24 along the length of frame 12 at an opposing second lateral edge of frame 12. In alternative embodiments, frame 12 may include any suitable number of scissor assemblies 20 and corresponding support members 40. Support members 40 extend and retract to facilitate moving frame 12 between the collapsed configuration and the extended configuration while providing additional support to frame 12 about the periphery of frame 12.

A plurality of backrest support members 52 are arranged with respect to, such as at or near, a third or middle longitudinal row or line 54 defined by upper connector assemblies 24 along the length of frame 12. In one embodiment, frame 12 includes a suitable number of backrest support members 52 corresponding to the number of upper connector assemblies 24 positioned along middle longitudinal line 54. As shown in FIG. 5, a coupling mechanism 60 is slidably coupled to backrest support member 52 to operatively couple backrest support members 52 to frame 12. More specifically, a first coupler 62 defines one or more openings 63 through which backrest support member 52 is slidably positioned. A second coupler 64 is pivotally coupled to first coupler 62 and slidably positioned about first frame member 16. More specifically, second coupler 64 defines a bore 65 through which first frame member 16 is positioned. Backrest support member 52 is pivotally coupled to first end 32 of second frame member 18 of scissor assembly 20 at or near lower connector assembly 28.

Backrest support member 52 is pivotally movable with respect to second frame member 18 to adjust an angular position of backrest support member 52 with respect to second frame member. Backrest support member 52 is pivotally movable with respect to second frame member 18 between a first position, as shown in FIG. 1, wherein backrest support member 52 is positioned at an angle, $\alpha$, greater than about 0°, with respect to second frame member 18, and a second position, as shown in FIG. 2, wherein backrest support member 52 is positioned adjacent to and/or parallel with second frame member 18 wherein angle, $\alpha$, approaches or is equal to 0°. With backrest support member 52 in the second position, second coupler 64 is seated against pivot point 19 of scissor assembly 20. In one embodiment, backrest support member 52 is positioned adjacent to and/or parallel with support member 40 in the first position. In a particular embodiment, backrest support member 52 is pivotally movable with respect to second frame member 18 to adjust a position of backrest support member 52 to a suitable angle, $\alpha$, such that a back support 68, shown in FIG. 6, provides adequate back support for a user seated on sofa bed 10.

Referring further to FIG. 5, second coupler 64 includes a locking device 70 configured to secure second coupler 64 in a desired position along a length of first frame member 16 to position backrest support member 52 at a desirable angle, $\alpha$, with respect to second frame member 18. In one embodiment, locking device 70 forms a recess 72 within a housing 74 and includes a lever 76 positioned within recess 72. A pin (not shown) is operatively coupled to lever 76 such that the pin extends through second coupler 64 and into an aligned aperture 78 defined within first frame member 16 to releasably lock or secure second coupler 64 to first frame member 16 at a desired position. In one embodiment, first frame member 16 defines a plurality of apertures 78 along a length of first frame member 16 that are configured to receive the pin to facilitate adjusting the angular position of backrest support member 52 with respect to second frame member 18, as desired. In one embodiment, a spring (not shown) is operatively coupled to the pin and biases the pin to extend outwardly from second coupler 64 and into aligned aperture 78.

With sofa bed 10 in the expanded sofa configuration as shown in FIG. 6, mattress 14 is coupled directly, or indirectly with a suitable cover or enclosure, to upper connector assemblies 24 along second longitudinal line 50 and third longitudinal line 54. Further, mattress 14 is coupled directly or indirectly to an upper end of each backrest support member 52 to form back support 68 of sofa bed 10. With sofa bed 10 in the expanded bed configuration as shown in FIG. 7, mattress 14 is coupled to upper connector assemblies 24 along second longitudinal line 50 and third longitudinal line 54. Further, mattress 14 is coupled to backrest support members 52, which may be coupled to corresponding upper connector assemblies 24 along first longitudinal line 48.

With frame 12 in the expanded configuration, frame support members 40 are retracted such that frame 12 forms a substantially planar support area 80, as shown in FIG. 2. In one embodiment, as backrest support members 52 are pivotally moved away from corresponding second frame member 18, second coupler 64 slides upwardly along a length of first frame member 16 and first coupler 62 moves downwardly along a length of backrest support member 52 until the pin positioned within second coupler 64 reaches an aligned aperture 78 defined within first frame member 16. The spring urges the pin into aligned aperture 78 to secure second coupler 64 to first frame member 16. In this configuration, mattress 14 defines an angle of elevation such that sofa bed 10 is configured in the expanded sofa configuration. Additional apertures 78 are defined within first frame member 16 to adjust the angle of elevation, as desired. With application of a suitable force to lever 76, the pin is removed from within aperture 78, and backrest support members 52 can pivotally move with respect to second frame member 18 downward to a lowest rotation point until second coupler 64 is seated against pivot point 19 to positioned sofa bed 10 in the expanded bed configuration.

The present disclosure provides a collapsible sofa bed that is configurable in a bed configuration or a sofa configuration. Further, the sofa bed is fully collapsible. The sofa bed includes a frame assembly composed of a plurality of scissor assemblies. Adjacent members of each scissor assembly are coupled together at an upper end and a lower end of each member. A plurality of backrest support members are positioned along a longitudinal line defined along a length of the frame. Each backrest support member is coupled at a lower end to a lower portion of a second frame member and an upper end of each backrest support member is selectively coupled to or positioned with a rear upper connector assembly of the frame or is slidable along a corresponding first frame member and pivotally movable with respect to the second frame member to extend upward from a planar support area defined by the frame. A mattress and/or a cover is coupled at a first or front edge portion to a front upper connector assembly of the frame and a second or rear edge portion is coupled to the upper ends of the backrest support members.

The above-described sofa bed having a collapsible and convertible frame facilitates providing a sleeping area or a seating area quickly and efficiently. More specifically, the collapsible frame is movable between a collapsed configuration, facilitating storage and/or transportation of the sofa bed, and an expanded configuration, such as a bed configuration or a sofa configuration, defining a support structure configured to support a mattress and one or more users. Further, the frame is movable between the bed configuration and the sofa configuration easily and efficiently, as desired.

Exemplary embodiments of a sofa bed including a collapsible and convertible frame and a method for constructing a sofa bed are described above in detail. The apparatus and method are not limited to the specific embodiments described herein, but rather, components of the apparatus and/or steps of the method may be utilized independently and separately from other components and/or steps described herein. Further, the described apparatus components and/or method steps can also be defined in, or used in combination with, other apparatus and/or methods, and are not limited to practice with only the apparatus and method as described herein.

While the invention has been described in terms of various specific embodiments, those skilled in the art will recognize that the invention can be practiced with modification within the spirit and scope of the claims.

What is claimed is:

1. A collapsible sofa bed movable between an expanded configuration and a collapsed configuration, the collapsible sofa bed comprising:

a mattress;

a frame removably coupled to the mattress, the frame comprising:

a first plurality of frame support members along the first lateral edge of the frame, each of the first plurality of frame support members coupled between one of a plurality of upper connector assemblies and a corresponding one of a plurality of lower connector assemblies;

a second plurality of frame support members along a second lateral edge of the frame, each of the second plurality of frame support members coupled between one of the plurality of upper connector assemblies and a corresponding one of the plurality of lower connector assemblies, the second lateral edge substantially parallel to the first lateral edge;

a middle frame support member, the middle frame support member coupled between one of the plurality of upper connector assemblies and a corresponding one of the plurality of lower connector assemblies; and a plurality of scissor assemblies including at least a first scissor assembly and a second scissor assembly, each scissor assembly of the plurality of scissor assemblies comprising a first frame member pivotally coupled to a second frame member at a pivot point, the first scissor assembly coupled to the middle frame support member at a corresponding one of the plurality of upper connector assemblies and a corresponding one of the plurality of lower connector assemblies, and to the first plurality of frame support members at a corresponding one of the plurality of upper connector assemblies and a corresponding one of the plurality of lower connector assemblies, the second scissor assembly coupled to the middle frame support member at a corresponding one of the plurality of upper connector assemblies and a corresponding one of the plurality of lower connector assemblies, and to the second plurality of frame support members at a corresponding one of the plurality of upper connector assemblies and a corresponding one of the plurality of lower connector assemblies;

at least two backrest support members coupled to the frame and with respect to a middle longitudinal row of upper connector assemblies of the plurality of upper connector assemblies, the middle longitudinal row of upper connector assemblies aligned with the middle frame support member, each backrest support member of the at least two backrest support members slidably coupled to a corresponding first frame member and having a lower end pivotally coupled to a corresponding second frame member, the corresponding first frame member and the corresponding second frame member being coupled to one of the first plurality of frame support members along the first lateral edge of the frame or one of the second plurality of frame support members along the second lateral edge of the frame, each backrest support member pivotally movable with respect to the corresponding second frame member to adjust an angular position of each backrest support member with respect to the corresponding second frame member to facilitate moving the collapsible sofa bed to a sofa configuration;

a coupling mechanism coupling each backrest support member of the at least two backrest support members to the corresponding first frame member; and a locking device configured to secure the coupling mechanism in a desired position along a length of the corresponding first frame member, wherein the first frame member includes a plurality of apertures defined therein such that the collapsible sofa bed is securable in a plurality of inclined configurations including the sofa configuration.

2. A collapsible sofa bed in accordance with claim 1 wherein, in a first position, each backrest support member is positioned at a first angle with respect to the corresponding second frame member.

3. A collapsible sofa bed in accordance with claim 2 wherein the first angle is adjustable.

4. A collapsible sofa bed in accordance with claim 2 wherein, in a second position, each backrest support member is positioned adjacent the corresponding second frame member.

5. A collapsible sofa bed in accordance with claim 4 wherein, in the second position, each backrest support member is coupled to a corresponding one of the plurality of upper connector assemblies.

6. A collapsible sofa bed in accordance with claim 1 wherein the coupling mechanism comprises:

a first coupler slidably positioned about the backrest support member; and a second coupler pivotally coupled to the first coupler and slidably positioned about the corresponding first frame member.

7. A collapsible sofa bed in accordance with claim 6 wherein, with the backrest support member positioned adjacent the corresponding second frame member, the second coupler is seated against the pivot point.

8. A collapsible sofa bed in accordance with claim 6 wherein the locking device is configured to secure the second coupler in the desired position along the length of the corresponding first frame member, wherein the locking device comprises a pin extending into a first aperture of the plurality of apertures to secure the second coupler to the corresponding first frame member.

9. A collapsible sofa bed in accordance with claim 8 further comprising:

a spring biasing the pin to extend outwardly from the second coupler and into the first aperture; and a lever operatively coupled to the pin and configured to retract the pin into a second coupler housing to facilitate slidably moving the second coupler along the length of the corresponding first frame member.

10. A collapsible sofa bed in accordance with claim 1 wherein the mattress is coupled along a first edge to a first row of upper connector assemblies and coupled along a laterally opposing second edge to the at least two backrest support members.

11. A collapsible frame movable between an expanded configuration and a collapsed configuration, the collapsible frame comprising:

a first plurality of frame support members along the first lateral edge of the frame, each of the first plurality of frame support members coupled between one of a plurality of upper connector assemblies and a corresponding one of a plurality of lower connector assemblies;

a second plurality of frame support members along a second lateral edge of the frame, each of the second plurality of frame support members coupled between one of the plurality of upper connector assemblies and a corresponding one of the plurality of lower connector assemblies, the second lateral edge substantially parallel to the first lateral edge;

a middle frame support member, the middle frame support member coupled between one of the plurality of upper connector assemblies and a corresponding one of the plurality of lower connector assemblies; and a plurality of scissor assemblies including at least a first scissor assembly and a second scissor assembly, each scissor assembly of the plurality of scissor assemblies comprising a first frame member pivotally coupled to a second frame member at a pivot point, the first scissor assembly coupled to the middle frame support member at a corresponding one of the plurality of upper connector assemblies and a corresponding one of the plurality of lower connector assemblies, and to the first plurality of frame support members at a corresponding one of the plurality of upper connector assemblies and a corresponding one of the plurality of lower connector assemblies, the second scissor assembly coupled to the middle frame support member at a corresponding one of the plurality of upper connector assemblies and a corresponding one of the plurality of lower connector assemblies, and to the second plurality of frame support members at a corresponding one of the plurality of upper connector assemblies and a corresponding one of the plurality of lower connector assemblies;

a plurality of backrest support members coupled to the frame and with respect to a middle longitudinal row of upper connector assemblies of the plurality of upper connector assemblies, the middle longitudinal row of upper connector assemblies aligned with the middle frame support member, each backrest support member of the plurality backrest support members slidably coupled to a corresponding first frame member and having a first end pivotally coupled to a corresponding second frame member, the corresponding first frame member and the corresponding second frame member being coupled to one of the first plurality of frame support members along the first lateral edge of the frame or one of the second plurality of frame support members along the second lateral edge of the frame, and each backrest support member pivotally movable with respect to the corresponding second frame member to adjust an angular position of each backrest support member with respect to the corresponding second frame member to facilitate moving the collapsible frame to a sofa configuration;

a coupling mechanism coupling each backrest support member of the plurality of backrest support members to the corresponding first frame member; and a locking device configured to secure the coupling mechanism in a desired position along a length of the corresponding first frame member, wherein the first frame member includes a plurality of apertures defined therein such that the collapsible frame is securable in a plurality of inclined configurations including the sofa configuration.

12. A collapsible frame in accordance with claim 11 wherein, in a first position, each backrest support member is adjustably positioned at a first angle with respect to the corresponding second frame member.

13. A collapsible frame in accordance with claim 12 wherein, in a second position, each backrest support member is positioned adjacent the corresponding second frame member and coupled to a corresponding one of the plurality of upper connector assemblies.

14. A collapsible frame in accordance with claim 11, wherein the coupling mechanism comprises:

a first coupler slidably positioned about the backrest support member; and a second coupler pivotally coupled to the first coupler and slidably positioned about the corresponding first frame member.

15. A collapsible frame in accordance with claim 14 wherein, with the backrest support member positioned adjacent the corresponding second frame member, the second coupler is seated against the pivot point.

16. A collapsible frame in accordance with claim 14 wherein the locking device is configured to secure the second coupler in the desired position along the length of the corresponding first frame member, wherein the locking device comprises a pin extending into a first aperture of the plurality of apertures to secure the second coupler to the corresponding first frame member.

17. A collapsible frame in accordance with claim 16 further comprising a spring biasing the pin to extend outwardly from the second coupler and into the first aperture.

18. A sofa bed comprising:

the collapsible frame of claim 11; and an inflatable mattress operatively coupled to the collapsible frame.

19. A sofa bed in accordance with claim 18 wherein the inflatable mattress is coupled along a first edge to a first row of upper connector assemblies and coupled along a laterally opposing second edge to the plurality of backrest support members.

20. A method for manufacturing a collapsible frame assembly, the method comprising:

forming a collapsible frame comprising:

a first plurality of frame support members along the first lateral edge of the frame, each of the first plurality of frame support members coupled between one of a plurality of upper connector assemblies and a corresponding one of a plurality of lower connector assemblies;

a second plurality of frame support members along a second lateral edge of the frame, each of the second plurality of frame support members coupled between one of the plurality of upper connector assemblies and a corresponding one of the plurality of lower connector assemblies, the second lateral edge substantially parallel to the first lateral edge;

a middle frame support member, the middle frame support member coupled between one of the plurality of upper connector assemblies and a corresponding one of the plurality of lower connector assemblies; and a plurality of scissor assemblies including at least a first scissor assembly and a second scissor assembly, each scissor assembly of the plurality of scissor assemblies comprising a first frame member pivotally coupled to a second frame member at a pivot point, the first scissor assembly coupled to the middle frame support member at a corresponding one of the plurality of upper connector assemblies and a corresponding one of the plurality of lower connector assemblies, and to the first plurality of frame support members at a corresponding one of the plurality of upper connector assemblies and a corresponding one of the plurality of lower connector assemblies, the second scissor assembly coupled to the middle frame support member at a corresponding one of the plurality of upper connector assemblies and a corresponding one of the plurality of lower connector assemblies, and to the second plurality of frame support members at a corresponding one of the plurality of upper connector assemblies and a corresponding one of the plurality of lower connector assemblies;

coupling a plurality of backrest support members to the frame and with respect to a middle longitudinal row of upper connector assemblies of the plurality of upper connector assemblies, the middle longitudinal row of upper connector assemblies aligned with the middle frame support member, each backrest support member of the plurality backrest support members slidably coupled to a corresponding first frame member and having a first end pivotally coupled to a corresponding second frame member, the corresponding first frame member and the corresponding second frame member being coupled to one of the first plurality of frame support members along the first lateral edge of the frame or one of the second plurality of frame support members along the second lateral edge of the frame, each backrest support member pivotally movable with respect to the corresponding second frame member to adjust an angular position of each backrest support member with respect to the corresponding second frame member to facilitate moving the collapsible frame assembly to a sofa configuration; and slidably coupling a coupling mechanism about each backrest support member of the plurality of backrest support members to couple each backrest support member to the corresponding first frame member, wherein a locking device is configured to secure the coupling mechanism in a desired position along a length of the corresponding first frame member, and the first frame member includes a plurality of apertures defined therein such that the collapsible frame is securable in a plurality of inclined configurations including the sofa configuration.

21. A method in accordance with claim 20 wherein the coupling mechanism comprises a first coupler slidably positioned about the backrest support member and a second coupler pivotally coupled to the first coupler and slidably positioned about the corresponding first frame member.

* * * * *